United States Patent [19]

Szpur

[11] Patent Number: 4,768,140

[45] Date of Patent: Aug. 30, 1988

[54] INDOOR LIGHT FIXTURE FOR HIGH INTENSITY LAMP

[76] Inventor: Roman Szpur, 2685 Culver Ave., Dayton, Ohio 45429

[21] Appl. No.: 51,403

[22] Filed: May 19, 1987

[51] Int. Cl.[4] ..... F21V 7/20

[52] U.S. Cl. ..... 362/342; 362/263; 362/346; 362/367

[58] Field of Search ..... 362/147, 290, 342, 346, 362/305, 404, 302, 300, 303, 367, 263

[56] References Cited

U.S. PATENT DOCUMENTS

| | | | |
|---|---|---|---|
| 1,906,559 | 5/1933 | Ferree et al. | 362/408 |
| 2,625,646 | 1/1953 | Goebel . | |
| 3,033,981 | 5/1962 | Kushner . | |
| 3,169,710 | 2/1965 | Lipscomb . | |
| 3,389,246 | 6/1968 | Shemitz | 362/325 |
| 4,186,433 | 1/1980 | Baldwin | 362/404 |
| 4,414,609 | 11/1983 | Shemitz | 362/247 |

*Primary Examiner*—Ira S. Lazarus
*Assistant Examiner*—Sue Hagarman
*Attorney, Agent, or Firm*—Jacox & Meckstroth

[57] ABSTRACT

A high pressure sodium lamp has a horizontal light source and is supported by a socket and frame which includes a horizontal reflecting plate member positioned below the lamp. A pair of open grid-type reflector panels are supported by the plate member on opposite sides of the lamp and at inclined angles to reflect light rays downwardly while preventing direct viewing of the light source through the panels. The frame is supported below the ceiling of a room, and in one embodiment, a rectangular open bottom and open top translucent shade surrounds the lamp and reflector panels. All light rays emanating from the light source are reflected within the room to produce 100% indirect lighting, and air flows upwardly through the panels and around the lamp to provide for cooling and self-cleaning of the lamp.

12 Claims, 2 Drawing Sheets

20
19
12
13
17
62
10
60
62
64
64
45
45
55
62

29
19
13
17
12
22
68
17
25
23
69
45
34
68
16
41
56
55
45

62
66
17
13
29
22
64
60
64
62
12
36
23
62
17
25
16
66
36
64
36
37
51
64
36
34
37
51
41
48
38
38
56
38
45
55
38

29
12
13
17
31
22
64
60
62
25
27
66
45
56
45
41
51
36
16
41
34
37
36
51
36
48
38
38
47
A
55
38

INDOOR LIGHT FIXTURE FOR HIGH INTENSITY LAMP

BACKGROUND OF THE INVENTION

There have been many forms of indoor light fixtures either constructed or proposed for producing indirect lighting within a room of a building. Frequently, florescent lamps provide the light source, and the lamps are enclosed within suspended housings or undercut ceiling portions for reflecting from the ceiling all of the light rays emanating from the florescent lamps. There has also been constructed a suspended light fixture wherein a high pressure sodium lamp is positioned within a pan-like reflector with the light source of the lamp being horizontal. The light rays directed outwardly and downwardly from the lamp are reflected upwardly towards the ceiling by the pan-like reflector which receives the lamp. The lamp and reflector pan are surrounded by a heat resistent glass lens.

It has been found desirable for an indoor light fixture to utilize an efficient high intensity lamp such as a high pressure sodium lamp and to provide for diffusing, refracting and reflecting all of the light rays emanating from the lamp both downwardly and upwardly as well as outwardly from the lamp while also preventing direct viewing of the light source. It has also been found desirable to provide for an upward flow of air through the fixture and around the lamp to provide for self-cleaning of the lamp as well as cooling of the lamp. However, none of the light fixtures constructed or proposed prior to the present invention provide all of these desirable features.

SUMMARY OF THE INVENTION

The present invention is directed to an improved indoor light fixture which utilizes a high intensity lamp such as a high pressure sodium lamp and which provides all of the desirable features mentioned above. Thus the light fixture of the invention provides for supporting a high pressure sodium lamp with a horizontal axis spaced below the ceiling of a room and for efficiently reflecting and diffusing all of the light rays emanating from the light source. The light rays directed upwardly from the light source are reflected from the ceiling and walls, and light rays directed outwardly and downwardly from the light source are reflected downwardly to provide for 100% reflected light within the room and corresponding indirect illumination of the room.

In accordance with one embodiment of the invention, an aluminum frame supports a junction box having a socket which supports a high pressure sodium lamp with its light source extending horizontally. An aluminum reflector panel forms the base of the frame and supports a pair of open grid-type light reflector panels each positioned at an incline of about 15° from a horizontal plane. The reflector panels have square openings or cells defined by parallel spaced walls which reflect light rays downwardly while preventing direct viewing of the light source. The walls of the reflector panels may be coated with a filtering material which refracts the light rays so that a more desirable color is reflected. The frame, lamp and reflector panels are supported below the ceiling, for example, by a depending tubular post or by a tubular post which projects upwardly from a base housing enclosing the ballast for the lamp.

In another embodiment, the lamp and reflector panels are surrounded by a rectangular open top and open bottom shade member which rests on the reflector panels and has translucent side walls cooperating to diffuse light rays within the room.

Other features and advantages of the invention will be apparent from the following description, the accompanying drawings and the appended claims.

DESCRIPTION OF THE PREFERRED EMBODIMENT

Figure 1:
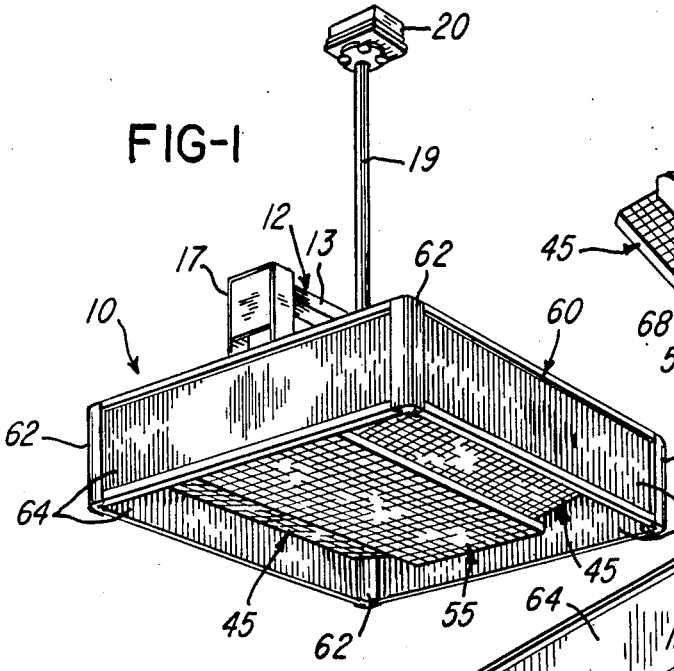
FIG. 1 is a perspective view of a light fixture constructed in accordance with the invention and being suspended from a ceiling.
Figure 3:
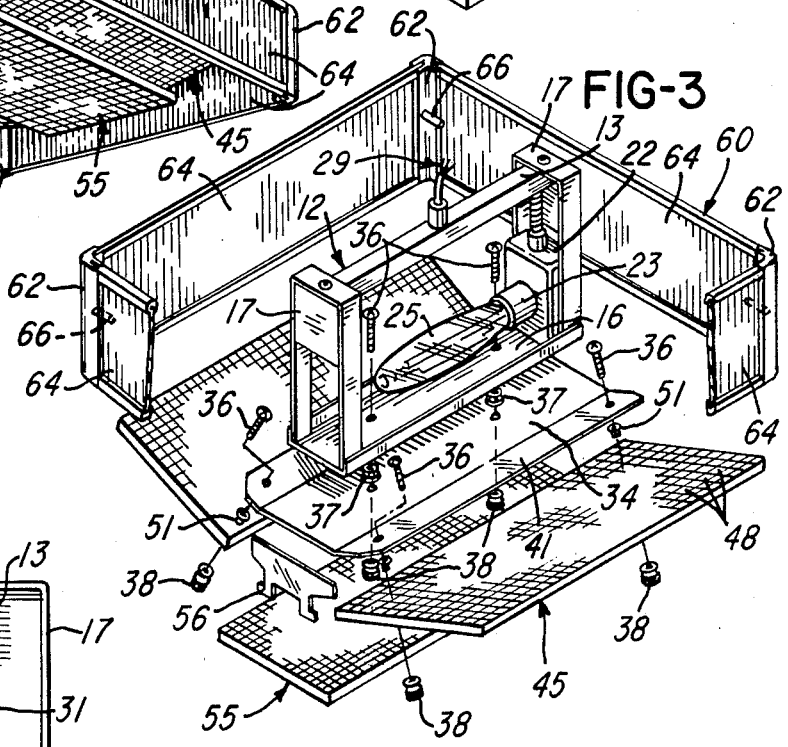
FIG. 3 is an exploded perspective view of the light fixture shown in FIG. 1 and with portions broken away to show internal construction.

FIGS. 1 and 3 illustrate a suspended light fixture assembly 10 which includes a frame 12 having a tubular horizontal cross member 13 rigidly connected to a bottom cross or base reflector channel member or plate 16 by a pair of end brackets 17. Preferably, the components of the frame 12 are formed of aluminum, and the frame is supported by a tubular post 19 depending from a junction box 20 secured to or recessed within the ceiling of a room.

Figure 4:
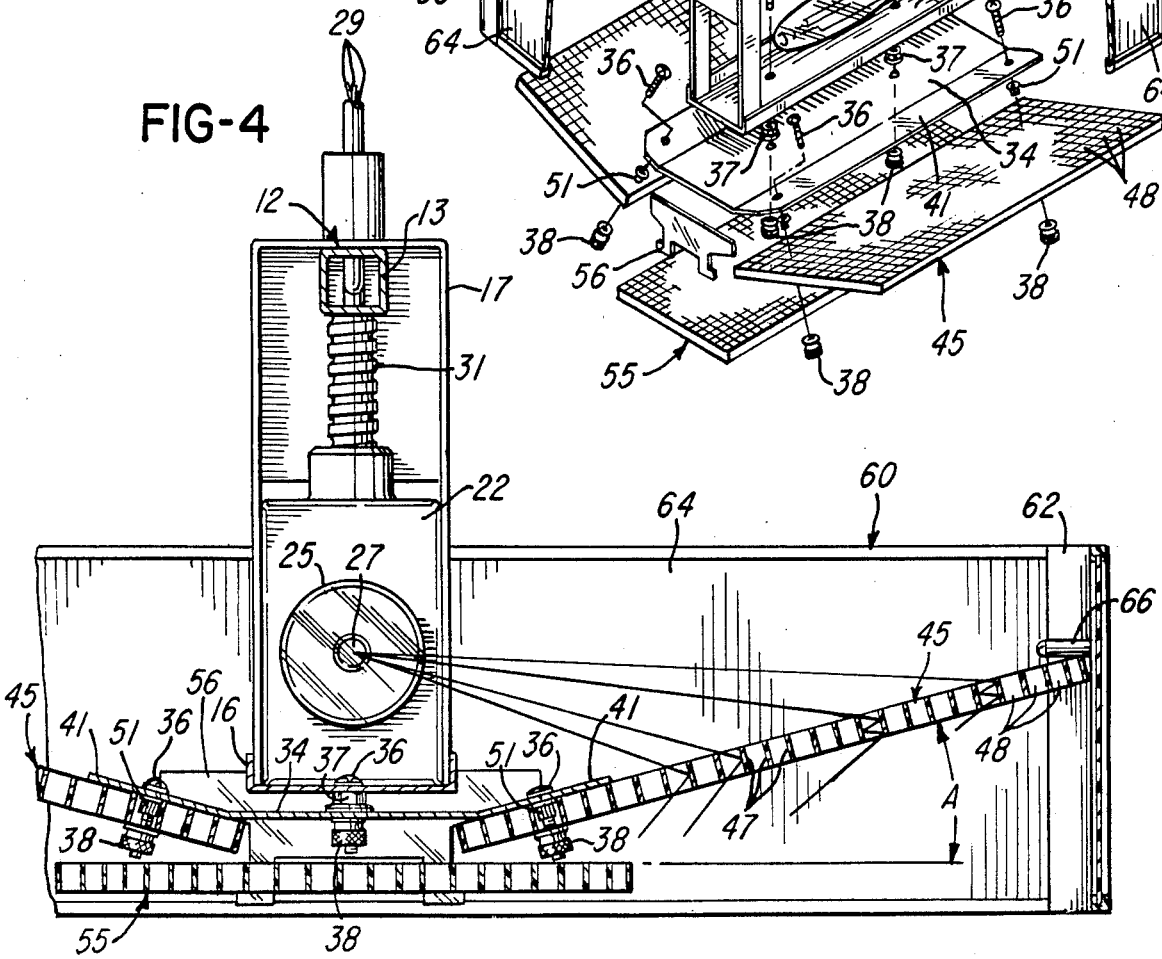
FIG. 4 is an enlarged fragmentary section of the light fixture shown in FIG. 1.

A junction box 22 (FIG. 3) is secured to the frame 12 within one of the end brackets 17 and supports a horizontally projecting lamp socket 23 spaced above the base channel or plate 16. An elongated high pressure sodium lamp 25 has a base threaded into the socket 23 and includes a horizontally extending linear light source 27 (FIG. 4). Electrical power is supplied to the lamp 25 through insulated wire conductors 29 which extend through the support post 19 and cross member 13 and through a conduit 31 to the junction box 22. The ballast for the fixture assembly 10 is remotely located, for example, within the ceiling above the fixture assembly.

An aluminum support and reflector plate 34 is supported below the reflector channel member 16 by a pair of bolts 36 (FIG. 4), spacer nuts 37 and knurled thumb nuts 38. The plate 34 has inclined edge or wing portions 41 which project at an angle between 10° and 20° and preferably at an angle of about 15° from a horizontal plane including the center portion of the plate 34. A pair of rectangular open grid-type light reflector panels 45 have parallel walls 47 in both X and Y directions to define square openings or cells 48. Preferably, each of the panels 45 is molded of a rigid plastics material with a thickness of about one-half inch, with each square opening being approximately one-half inch square. The inner edge portion of each panel 45 is secured to an edge or wing portion 41 of the support plate 34 by a pair of bolts 36 which are secured to the wing portions 41 by nuts 51. A pair of knurled thumb nuts 38 fasten each of the panels 45 to the corresponding wing portion 41 and provide for conveniently attaching each panel 45 to the plate 34 during assembly of the fixture.

A third open grid-type light reflector panel 55 is supported in a horizontal position below the plate 34 by a pair of hangers 56 which are die cut from a relatively thin flexible sheet plastics material. As shown in FIG. 4, the upper portions of the hangers 56 rest on the inner edge portions of the reflector panels 45 adjacent the ends of the support panel 34, and the lower hook portions of the hangers 56 are flexed to extend through corresponding openings within the reflector panel 55.

The embodiment shown in FIGS. 1, 3 and 4 further includes a square or rectangular frame-like reflector shade 60 which has an open top and an open bottom. The shade 60 includes four corner supports or posts 62 which have slots or grooves for receiving the end portions of semi-transparent or translucent panels 64. Each of the panels 64 is cut from an extruded sheet of semi-transparent plastics material. However, each panel 64 may also be formed of other materials which preferably provide for reflection and partial transmission of light. A support stud or pin 66 projects inwardly from each corner post 62, and the pins 66 rest on the outer edges of the reflector panels 45 to support the shade 60 in a position where it surrounds the lamp 25 and reflector panels 45 and 55. The shade 60 may be adjusted so that it is perfectly level by loosening one or two of the thumb screws 38.

The light fixture assembly 10 is preferably supported at least seven feet above the floor of a room so that all light rays directed outwardly from the light source 27 are reflected at least once by the walls 47 of the reflector panels 45, causing the reflected light rays to be directed downwardly from the fixture assembly. The light rays directed upwardly from the light source 27 and reflected upwardly from the bottom panels 16 and 34 are also reflected from the ceiling so that the entire room is illuminated by indirect lighting. The open top and open bottom of the shade 60 cooperate with the openings 48 within the reflector panels 45 to provide for a natural convection flow of air upwardly through the panels 45 and shade 60 as the air is heated by the lamp 25. This upward flow of air also provides for cooling and cleaning the outer surface of the lamp 25 to avoid the build-up of dust on the lamp 25.

Figure 2:
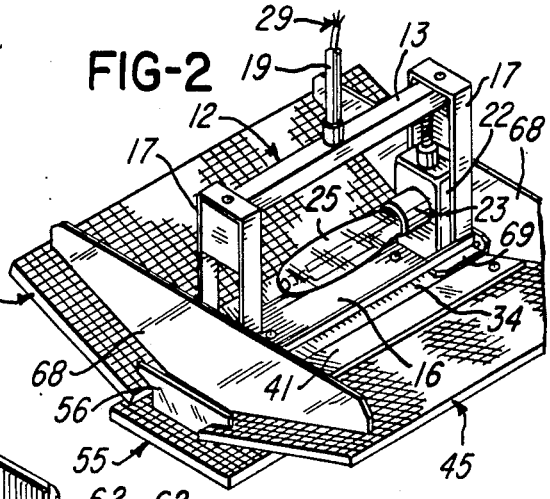
FIG. 2 is a perspective view of the light fixture shown in FIG. 1 and with a modification.

Referring to FIG. 2, the light fixture assembly 10 may also be used without the open surrounding shade 60. In place of the shade 60, a pair of semi-transparent or translucent end panels 68 are die cut from a light transmitting plastics material and conform to the inclined configuration of the reflector panels 45. Each end panel 68 is mounted on an L-shaped aluminum bracket 69 which slides or inserts into the space between the upper surface of the bottom panel 55 and the lower inner edges of the panels 45 to retain the end panel 68 in a vertical position. The fixture assembly shown in FIG. 2 is ideally suited for use in a room of a commercial or industrial building such as, for example, a super market or manufacturing area where efficient indirect lighting is desired.

Figure 5:
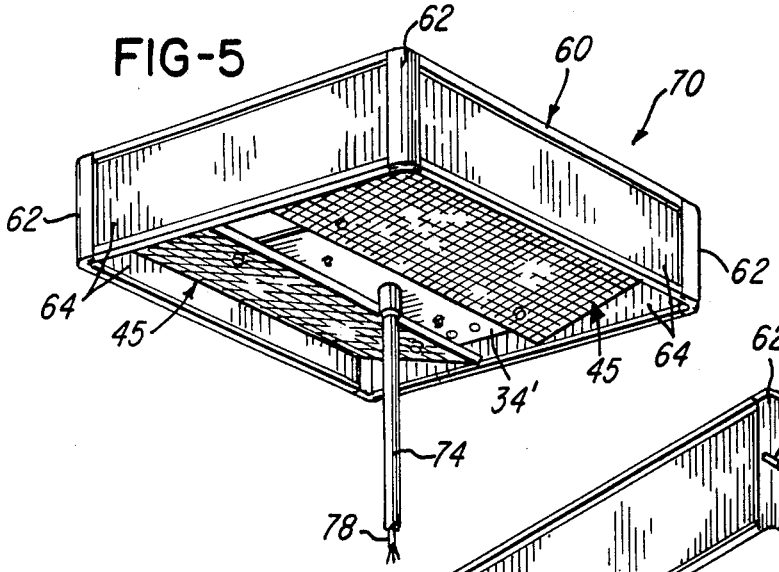
FIG. 5 is a perspective view of a light fixture constructed similar to the light fixture shown in FIG. 1 and supported below the ceiling by a vertical post projecting upwardly from a housing which encloses a ballast for the light fixture.
Figure 6:
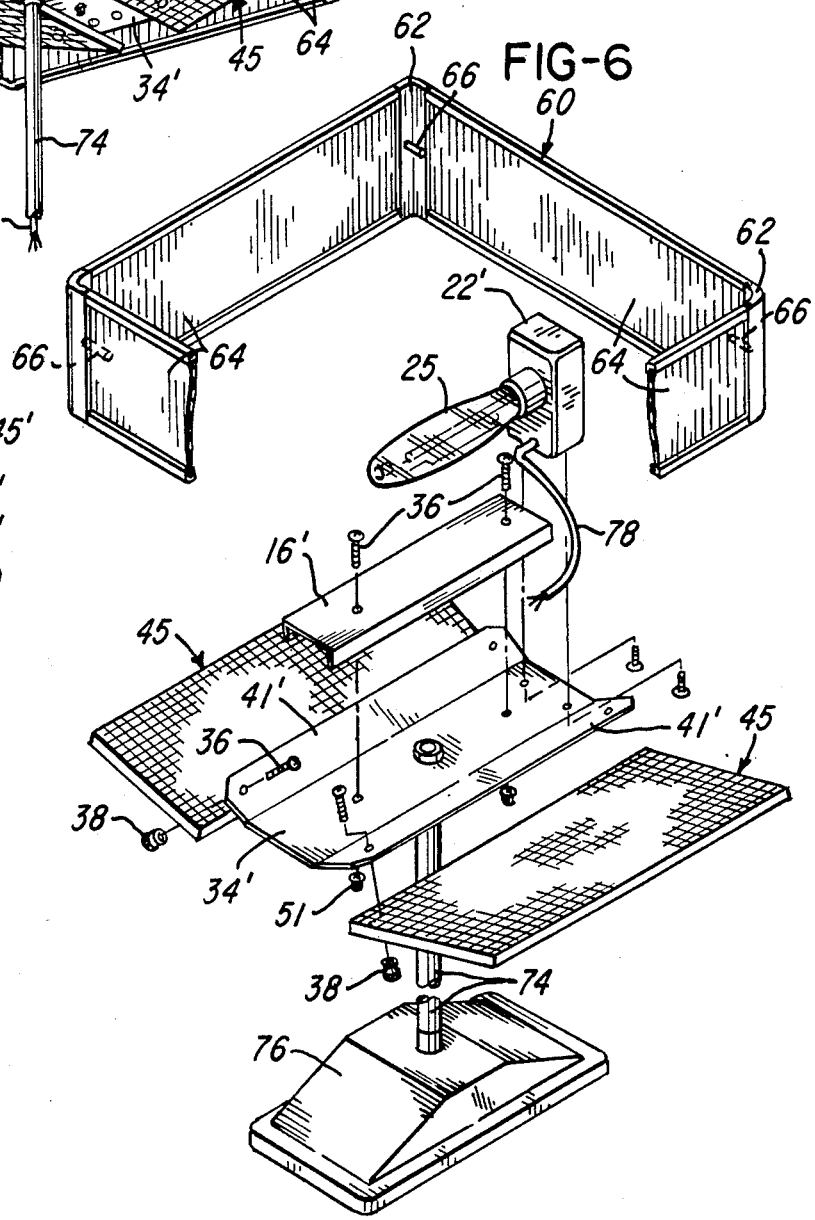
FIG. 6 is an exploded perspective view of the light fixture shown in FIG. 5 and with a portion broken away.

Referring to FIGS. 5 and 6, the light fixture assembly 70 is constructed similarly to the light fixture assembly 10 described above but is adapted to be supported by a floor or table mounted stand. Thus the components of the light fixture assembly 70 which are common to the light fixture assembly 10, are identified with the same reference numbers but with the addition of prime marks when the components have minor modifications. Thus the high pressure sodium lamp 25 is supported by a junction box 22' which is mounted on a plate 34'. The center of the base plate 34' is secured to the upper end portion of a tubular support stem or post 74, and the lower end portion of the post 74 is secured to a base housing 76 which encloses the ballast (not shown) for supplying power to the lamp 25.

The ballast housing 76 may be constructed of different materials such as cast aluminum, molded plastics or a ceramic material. A power supply cord 78 extends from the junction box 22' into an inverted channel reflector member 16' and then downwardly through the support post 74 to the ballast within the housing 76. A control switch (not shown) is mounted on the housing 76, and a power cord (not shown) extends from the housing 76 to a power supply line.

The open grid-type light reflector panels 45 mount on the edge or wing portions 41' of the panel 34' in the same manner as described above for the fixture assembly 10, and the open top and open bottom shade 60 is supported by the reflector panels 45 in the same manner as described above in connection with FIGS. 3 and 4. Preferably, the support post 74 has sufficient height to position the fixture assembly 70 at a level above six feet so that a person standing on the floor of the room does not have a direct view of the lamp 25 but only receives light rays which are reflected from either the ceiling or panels 45 or which are diffused by the shade 60.

Figure 7:
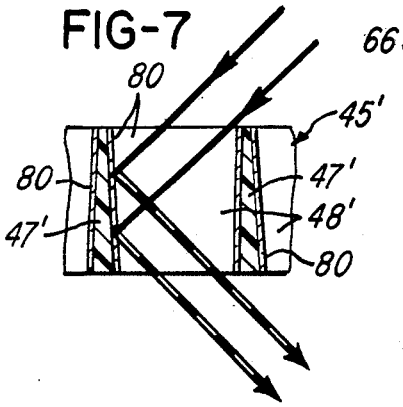
FIG. 7 is an enlarged fragmentary section of a reflector panel constructed in accordance with a modification of the invention.

Referring to FIG. 7, a modified open-grid reflector panel 45' has parallel spaced walls 47' to define generally square openings or cells 48'. The walls 47' are coated with a layer 80 of a semi-transparent reflection-refraction material which is effective to filter light rays of certain colors so that the reflected light is of a different color, for example, less yellow than the light produced by a standard high pressure sodium lamp.

From the drawings and the above description, it is apparent that a light fixture constructed in accordance with the present invention, provides desirable features and advantages. For example, each embodiment of the light fixture of the invention provides for substantially uniform illumination of a room with 100% indirect lighting whereby all light rays emanating from the lamp 25 are reflected from at least one surface which may be the ceiling or a surface of the fixture assembly. The open grid-reflector panels also provide for dispersing the light rays to provide for a more uniform distribution of the light in order to prevent glare and to provide a light distribution which is less tiring to a person's eyes.

As mentioned above, the open grid reflector panels and the position of the walls 47 with respect to the light source 27 not only prevent direct viewing of the light source 27 but also provide for an upward flow of air through the light reflector panels as the air above the panels is heated by the lamp 25 and rises above the light fixture. The shade 60 may also be used to provide the light fixture with a decorative appearance which may be desirable when the light fixture is used for lighting an office or similar room. It is also within the scope of the invention to mount the frame 12 directly on the T-bar of a suspended ceiling system by means of a pair of conventional scissor clips which are commonly used for gripping a T-bar. Furthermore, while a light fixture assembly constructed in accordance with the invention is ideally suited for using a high pressure sodium lamp 25, other high intensity and efficient lamps may be used such as, for example, metal halide lamps.

While the lighting fixture forms herein described constitute preferred embodiments of the invention, it is to be understood that the invention is not limited to these precise forms, and that changes may be made therein without departing from the scope and spirit of the invention as defined in the appended claims.

The invention having thus been described, the following is claimed:

1. An improved light fixture for obtaining efficient indirect illumination within a room of a building and adapted to use a high pressure sodium light source, said fixture comprising a frame including a generally horizontal reflector plate, a lamp socket mounted on said frame directly above said reflector plate and having a generally horizontal axis, an elongated lamp extending into said socket and having a generally horizontal high intensity light source spaced above said reflector plate, means for supporting said frame to position said lamp below the ceiling of the room, a generally square open grid-type light reflector panel assembly of rigid plastics material and having spaced walls defining a pattern of open cells therebetween, said panel assembly including a horizontal open grid-type reflector panel, means connected to said reflector plate and supporting said horizontal reflector panel directly below said light source and said reflector plate, said walls of said reflector panel assembly being positioned to reflect all of the light rays received by said panel assembly from said light source downwardly and to prevent direct viewing of said light source through said panel assembly, the space between said reflector panel assembly and the ceiling being open to provide for a flow of air upwardly through said panel assembly as air is heated by said light source, said reflector plate being positioned to prevent overheating of said horizontal reflector panel by said light source, a generally square open bottom and open top translucent shade surrounding said frame and reflector panel assembly and removably supported by said panel assembly, and said reflector plate and said reflector panel assembly cooperating with said shade and the ceiling to obtain full reflection of the light rays emanating from said light source to produce only indirect lighting of the room.

2. A light fixture as defined in claim 1 wherein said means for supporting said frame and said lamp spaced below the ceiling comprise a support post having an upper end portion secured to said reflector plate, a housing supporting a lower and portion of said post, and said housing enclosing a ballast for operating said lamp.

3. An improved light fixture for obtaining efficient indirect illumination within a room of a building and adapted to use a high pressure sodium light source, said fixture comprising a frame, a generally horizontal reflector plate connected to said frame and having opposite edge portions each inclined upwardly at an acute angle, a lamp socket mounted on said frame above said reflector plate and having a generally horizontal axis, an elongated lamp extending into said socket and having a generally horizontal high intensity light source spaced above said reflector plate, means for supporting said frame to position said lamp below the ceiling of the room, a pair of generally retangular open grid-type light reflector panels of rigid plastics material with each panel having spaced walls defining a pattern of open cells therebetween, means for securing said reflector panels to said inclined edge portions of said reflector plate to support said reflector panels below said light source and on opposite sides of a vertical reference plane including said light source, said walls of each said reflector panel being positioned to reflect all of the light rays received by said reflector panel from said light source downwardly and to prevent direct viewing of said light source through said reflector panel, a generally square open bottom and open top translucent shade member surrounding said frame and reflector panels, the space between said inclined reflector panels and the ceiling being open to provide for a flow of air upwardly through said reflector panels and said shade member as air is heated by said light source, said reflector plate being positioned to prevent overheating of said reflector panels by said light source, and said reflector plate and said reflector panels cooperating with said shade member and the ceiling to obtain full reflection of the light rays emanating from said light source to produce only indirect lighting of the room.

4. An improved light fixture for obtaining efficient indirect illumination within a room of a building and adapted to use a high pressure sodium light source, said fixture comprising a frame including a generally horizontal reflector plate member, a lamp socket mounted on said frame above said plate member and having a generally horizontal axis, an elongated lamp extending into said socket and having a generally horizontal high intensity light source spaced above said plate member, means for supporting said frame to position said lamp below the ceiling of the room, a pair of generally rectangular open grid-type light reflector panels of rigid plastics material with each panel having spaced walls defining a pattern of open cells therebetween, means connected to said plate member and supporting said reflector panels below said light source and on opposite sides of a vertical reference plane including said light source, each said panel being inclined upwardly at an acute angle generally between ten and twenty degrees from a horizontal plane, said walls of each said reflector panel being positioned to reflect all of the light rays received by said panel from said light source downwardly and to prevent direct viewing of said light source through said reflector panel, the space between said inclined reflector panels and the ceiling being open to provide for a flow of air upwardly through said reflector panels as air is heated by said light source, said plate member being positioned to prevent overheating of said reflector panels by said light source, a generally square open bottom and open top shade member surrounding said frame and said inclined reflector panels, and said plate member and said reflector panels cooperating with said shade member and the ceiling to obtain full reflection of the light rays emanating from said light source to produce only indirect lighting of the room.

5. A light fixture as defined in claim 4 wherein said reflector panels form an angle of about 150 degrees between said panels.

6. A light fixture as defined in claim 4 wherein said supporting means comprise a generally horizontal support plate having inclined opposite wing portions, and means for removably securing said reflector panels to corresponding said wing portions.

7. A light fixture as defined in claim 6 and including a third generally planar open grid-type light reflector panel, and means supporting said third panel in a generally horizontal position below said support plate and said pair of light reflector panels.

8. A light fixture as defined in claim 4 wherein said means for supporting said frame and said lamp in a position spaced below the ceiling comprise a support post having a lower end portion secured to said frame, and means for securing an upper end portion of said support post to the ceiling.

9. A light fixture as defined in claim 4 wherein said frame comprises an inverted U-shaped frame member having legs secured to said plate member disposed below said lamp, and means for securing said frame member to the ceiling.

10. A light fixture as defined in claim 4 wherein said shade member comprises opposing pairs of walls of a translucent material.

11. A light fixture as defined in claim 4 wherein said shade includes four corner posts, and a set of support elements projecting inwardly from said corner posts and engaging said reflector panels for supporting said shade member.

12. A light fixture as defined in claim 4 wherein said walls of each said reflector panel have a layer of light refracting material to provide for reflecting light rays having a modified color.

* * * * *